US006451171B1

(12) United States Patent
Jewitt

(10) Patent No.: US 6,451,171 B1
(45) Date of Patent: Sep. 17, 2002

(54) FABRIC DEWATERING DEVICE AND METHOD

(75) Inventor: Dennis Edward Jewitt, Kent (GB)

(73) Assignee: Metso Paper Karlstad AB, Karlstad (SE)

( * ) Notice: Subject to any disclaimer, the term of this patent is extended or adjusted under 35 U.S.C. 154(b) by 0 days.

(21) Appl. No.: 10/042,919

(22) Filed: Jan. 9, 2002

Related U.S. Application Data

(62) Division of application No. 09/736,511, filed on Dec. 13, 2000.

(51) Int. Cl.[7] ..... D21F 1/32; D21F 3/02

(52) U.S. Cl. ..... 162/199; 162/272; 162/274; 68/228; 68/22 R

(58) Field of Search ..... 162/199, 272, 162/273, 274, 275, 276, 279; 68/22 R, 22 B; 198/494, 495

(56) References Cited

U.S. PATENT DOCUMENTS

| | | | | |
|---|---|---|---|---|
| 3,279,977 A | | 10/1966 | Cirrito et al. | |
| 3,285,806 A | | 11/1966 | Justus et al. | |
| 3,347,740 A | | 10/1967 | Goumeniouk | |
| 3,376,653 A | | 4/1968 | Daane | |
| 3,647,621 A | | 3/1972 | Schiel | |
| 3,840,429 A | | 10/1974 | Busker et al. | |
| 4,116,762 A | | 9/1978 | Gardiner | |
| 4,124,942 A | * | 11/1978 | Ohls et al. | 34/115 |
| 4,267,017 A | | 5/1981 | North | |
| 4,474,644 A | * | 10/1984 | Poulsen | 134/9 |
| 4,584,058 A | * | 4/1986 | Lehtinen et al. | 162/199 |
| 4,698,134 A | | 10/1987 | Green et al. | |
| 5,611,892 A | | 3/1997 | Karvinen et al. | |
| 6,153,056 A | | 11/2000 | Schiel | |

FOREIGN PATENT DOCUMENTS

| | | |
|---|---|---|
| EP | 0 526 592 B1 | 4/1995 |
| GB | 1273827 | 5/1972 |
| JP | 38 204 | 1/1963 |
| SU | 0787530 | 12/1980 |
| WO | WO-96/23101 | 8/1996 |
| WO | WO 99/31318 A1 | 6/1999 |

OTHER PUBLICATIONS

Copy of International Search Report for PCT/SE01/02750 completed Mar. 19, 2002.

* cited by examiner

*Primary Examiner*—Peter Chin
*Assistant Examiner*—Carlos Lopez
(74) *Attorney, Agent, or Firm*—Alston & Bird LLP

(57) ABSTRACT

A device is provided for dewatering a fabric in which the fabric is used in a papermaking process that exposes it to water before it is directed to the fabric dewatering device. The fabric dewatering device includes leading and trailing guide rolls about which the fabric is partially wrapped to form a loop portion. The loop portion is suspended between the leading and trailing guide rolls and includes a trough portion with a relatively small diameter that is positioned below the axes of the guide rolls. Running the fabric through the trough portion at high speeds exposes the water trapped therein to high centrifugal forces. The centrifugal forces expel the water from the fabric. The geometry and positioning of the trough portion is maintained either through a difference in fabric speed maintained by the leading and trailing nips or by the use of a rider roll positioned within the loop. A non-contact sensor in proximity to the trough portion senses the position of the trough portion and provides feedback to a controller which controls the motion of the rolls.

17 Claims, 5 Drawing Sheets

FABRIC DEWATERING DEVICE AND METHOD

CROSS-REFERENCE TO RELATED APPLICATIONS

This is a division U.S. application Ser. No. 09/736,511, filed Dec. 13, 2000, which is hereby incorporated herein in its entirety by reference.

FIELD OF THE INVENTION

The present invention relates to fabric dewatering devices, and more specifically to the dewatering of continuously moving fabrics used in papermaking machines, wherein the fabric is guided through a small-radius turn which causes water to be expelled from the fabric via centrifugal force.

BACKGROUND OF THE INVENTION

Permeable fabrics, or belts, are often used in paper machines for supporting a paper web during the papermaking process. After the web is separated from the fabric, the fabric typically undergoes a partial or full-width cleaning or washing process. During the cleaning process, the fabric is exposed to water which the fabric tends to retain when it returns to receive a new portion of the paper web. Papermaking applications that involve a process of thermal drying of the paper web supported on a drying fabric are sensitive to the quantity of residual water retained by the fabric, since retained water may rewet the paper web. Thus, such drying fabrics must be treated to remove all, or at least a major part of, the residual water after cleaning. Other applications may also require fabrics to be at least partially dewatered to prevent the water from slinging onto other parts of the machinery or other parts of the paper web while the fabric is returning from the cleaning process to receive a new portion of the paper web.

Tissue paper production requires special types of fabrics to achieve a final product with a high bulk. Very often TAD fabrics, or other types of tissue-making fabrics or belts, are used for the manufacture of textured tissue or web. This requires a special textured structure of the fabric itself and, consequently, a definite fabric thickness. Thick, structured fabrics are especially prone to water absorption during washing and retention of that water in the deeper parts of the fabric structure.

Pressing is a conventional means of dewatering fabrics that tends to be effective for non-woven fabrics such as felt. However, pressing is not as effective for simple woven fabrics such as those used for forming or TAD applications. Such woven fabrics are prone to retain water due to their thickness and less compressible structure.

A roll press for squeezing water from a papermaking felt is disclosed in Great Britain Patent No. 1,273,827 ('827). The press has two press rolls with parallel axes and an intermediate roller which is of substantially smaller diameter than that of either press roll. The intermediate roll is located between the two press rolls so as to form two press nips with the respective press rolls. The intermediate roll is arranged offset to one side of the common axial plane of the two press rolls and is movable toward this common axial plane. The felt runs into the first nip from the side of the common axial plane remote from the intermediate roll and leaves the second nip towards the remote side. Tension in the felt draws the intermediate roll against the press rolls with sufficient linear pressure to compress the felt so as to squeeze water from the felt.

Vacuum pans are well known in the art for dewatering fabrics and consist of a collection pan connected to a vacuum source and in proximity to the travelling fabric. The vacuum source exerts a suction pressure on the fabric, drawing water out of the fabric and into the pan. Another well-known method is to use an air knife that blows air out a narrow slot and through the fabric, thus blowing water out of the fabric and into a collection pan. U.S. Pat. No. 4,116,762 to Gardiner ('762) teaches the use of a hollow, foraminous cylinder over which a felt is passed. The cylinder allows air flow through to the travelling felt to drive water out of the felt. For fabrics that are very permeable, methods such as the ones described above involving blowing or sucking air through the fabric require a very large air flow and flow velocity, and hence consume a great deal of energy.

Centrifugal force has been used to aid in the dewatering of fabrics by running the felt over a curved surface with a small radius at high speeds. The '827 and '762 patents use centrifugal force to aid dewatering to a certain extent. As another example, U.S. Pat. No. 6,153,056 to Schiel ('056) discloses a draining device that drains water by circulating a press felt loop about a short region of convex curvature on a guide roll. The centrifugal force displaces water out of the belt and into a collecting device.

Whenever a wet moving fabric changes direction, by passing around a roll or foil for instance, there is a tendency to throw off water. The magnitude of this tendency depends both on the angular velocity and duration for which this is maintained. A small radius and a large wrap angle will tend to maximize the water removal tendency. In the case of a lead roll, a small radius is difficult to achieve, especially when combined with a large wrap due to problems with roll deflection and critical speeds. Therefore, in the case of a lead roll a small radius is not practical, although a large wrap presents no difficulty. In the case of a foil or stationary element, a small radius can readily be achieved but the wrap must be severely limited in order to avoid fabric wear.

SUMMARY OF THE INVENTION

The present invention meets these and other needs, and is characterized by a fabric dewatering device and method in which a fabric to be dewatered is passed over a leading guide roll and a trailing guide roll. The leading guide roll is rotatable about its axis and the trailing guide roll is rotatable about its axis and is parallel to the axis of the leading guide roll. The leading and trailing guide rolls are spaced apart such that the fabric passes over a portion of a circumference of the leading guide roll and then over a portion of the circumference of the trailing guide roll, in the same rotational direction about both rolls. The fabric is wrapped about both rolls so as to form a fabric loop between the leading guide roll and the trailing guide roll. This fabric loop includes a trough portion spaced to one side of the plane defined by the axes of the guide rolls.

A control device controls passage of the fabric through the fabric dewatering device so as to maintain the position of the trough portion of the fabric loop. In one embodiment, the control device includes a drive connected to each of the rolls and operable to rotate each roll about an axis thereof in the same rotation direction. A sensor is used for detecting a position of the trough portion of the fabric loop and is connected to a controller. The controller and the drive control the rotational speed for each roll so as to maintain the position of the trough portion spaced to one side of the axes of the rolls such that the fabric loop has a radius of curvature sufficiently small to cause water to be expelled from the fabric by centrifugal force.

In another embodiment the control device includes a rider roll inserted within the trough portion so as to maintain the position and geometry of the fabric loop. The rider roll preferably has a diameter in the range of 50 mm to 100 mm. Smaller diameters result in greater centrifugal forces, but decrease the dwell time while larger diameters increase the dwell time of the fabric. Advantageously, the fabric has a wrap angle around the rider roll of about 200° to 300°. Tension in the fabric draws the rider roll against the guide rolls but there is no attempt to compress the fabric to squeeze water from the fabric. Rather, dewatering is accomplished primarily by centrifugal forces on the fabric passing about the rider roll. Dewatering can also be aided, in some embodiments, by making the rider roll permeable, and forcing or drawing air through the rider roll and the fabric wrapped thereabout.

In one embodiment, maintenance of the trough portion below the axes of the guide rolls is facilitated by way of a lead nip and a trailing nip. The lead nip is formed between a first surface and the leading guide roll while the trailing nip is formed between a second surface and the trailing guide roll. The fabric passes through the lead nip upstream of the trough portion and then through the trailing nip downstream of the trough portion. The first and second surfaces can be portions of a single top roll or two separate top rolls. Tension in the fabric is relieved in the lead nip such that the fabric loop is essentially free of tension in the machine direction.

In another embodiment, the two nips are formed by a single top roll that is deformable. The top roll is pressed with a greater force against the trailing guide roll than against the leading guide roll, whereby the trailing nip has a greater indentation than the lead nip. Any of the three rolls can be driven. The loop length can be regulated by controlling the indentation of the trailing nip.

BRIEF DESCRIPTION OF THE DRAWINGS

Figure 1:
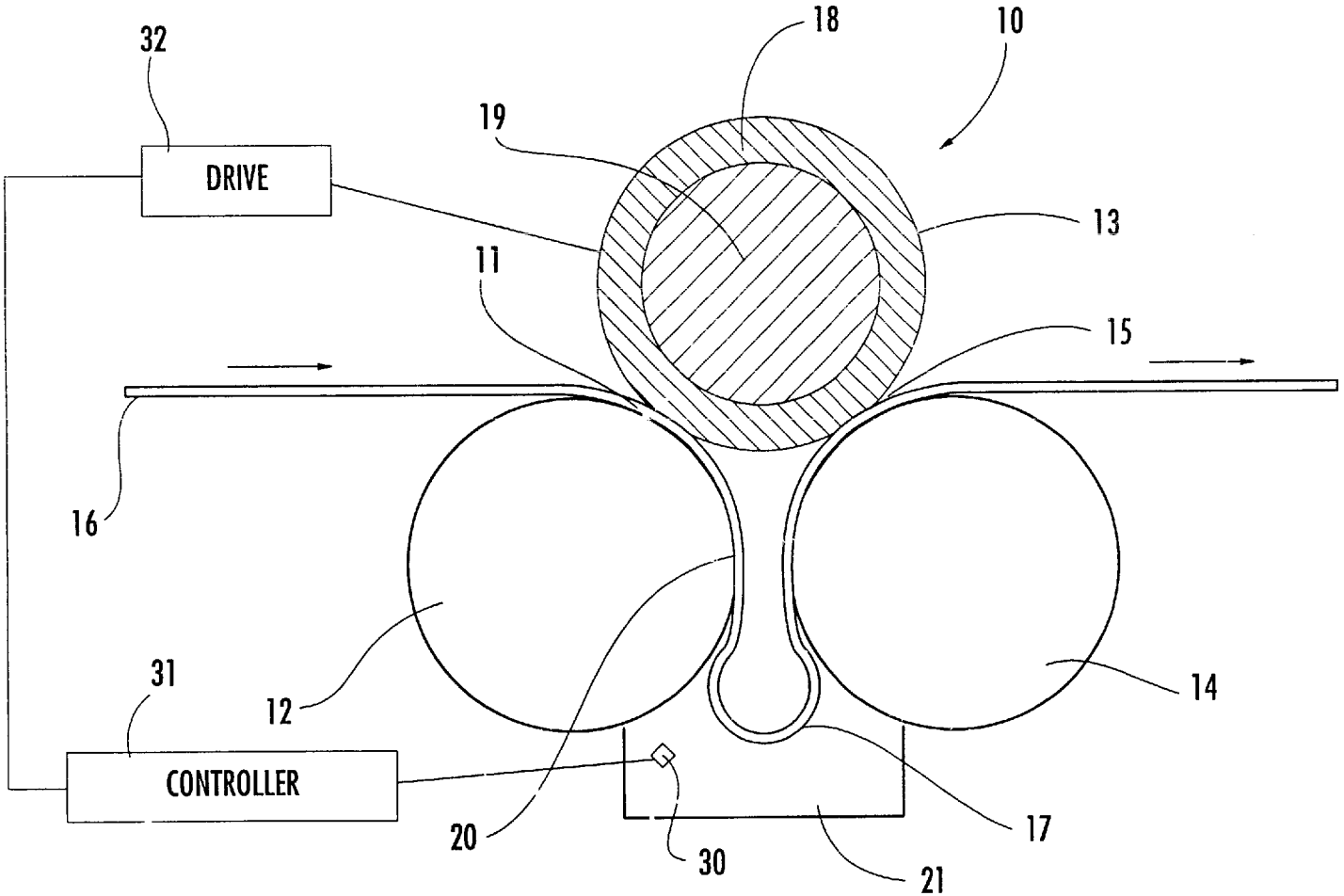

Having thus described the invention in general terms, reference will now be made to the accompanying drawings, which are not necessarily drawn to scale, and wherein:

FIG. 1 is a schematic side view of parts of the fabric dewatering device showing a first embodiment which includes a top roll which forms a leading nip and a trailing nip.

Figure 2:
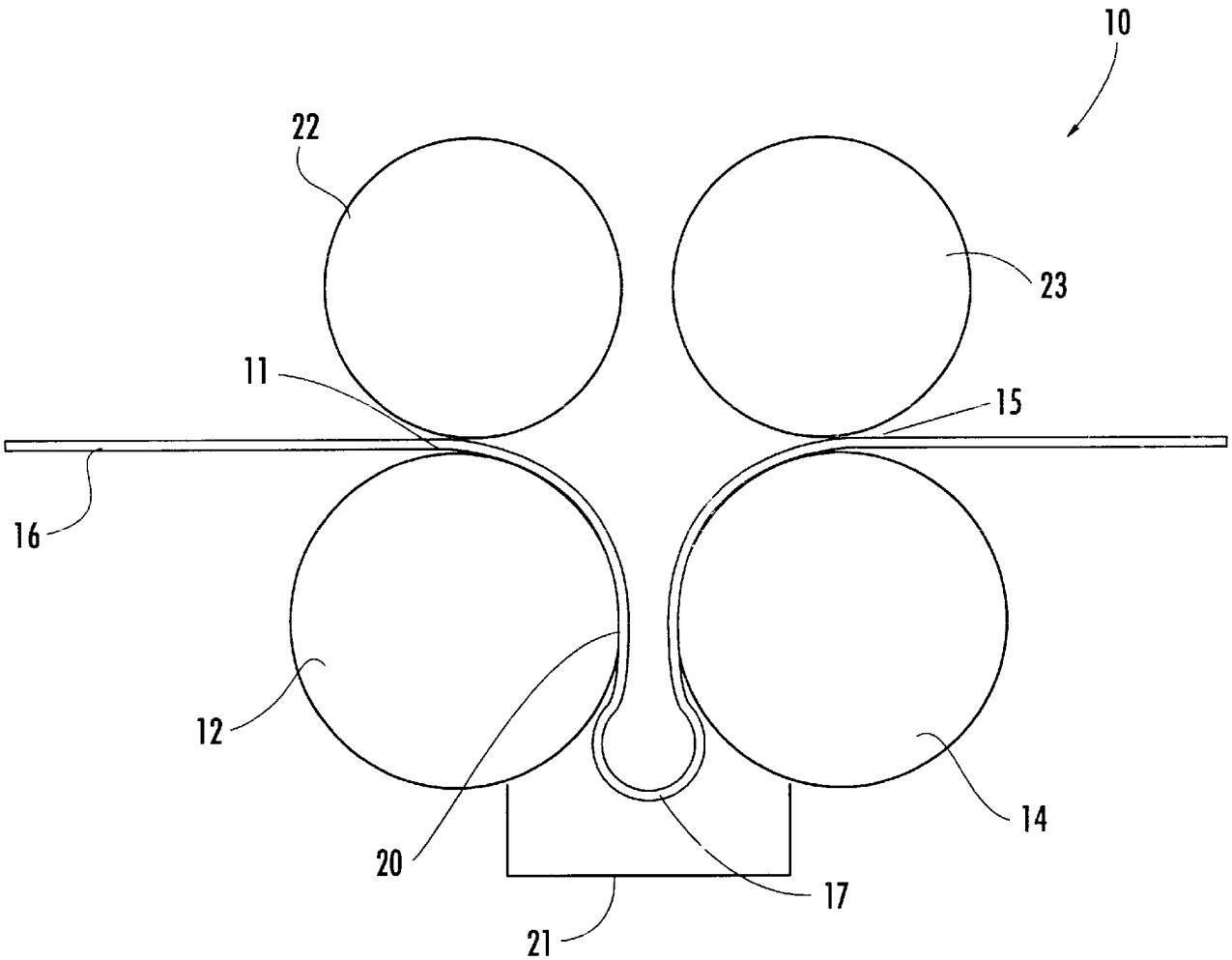

FIG. 2 is a schematic side view of parts of the fabric dewatering device showing a second embodiment which includes a top lead roll forming a lead nip and a top trailing roll forming a trailing nip.

Figure 3:
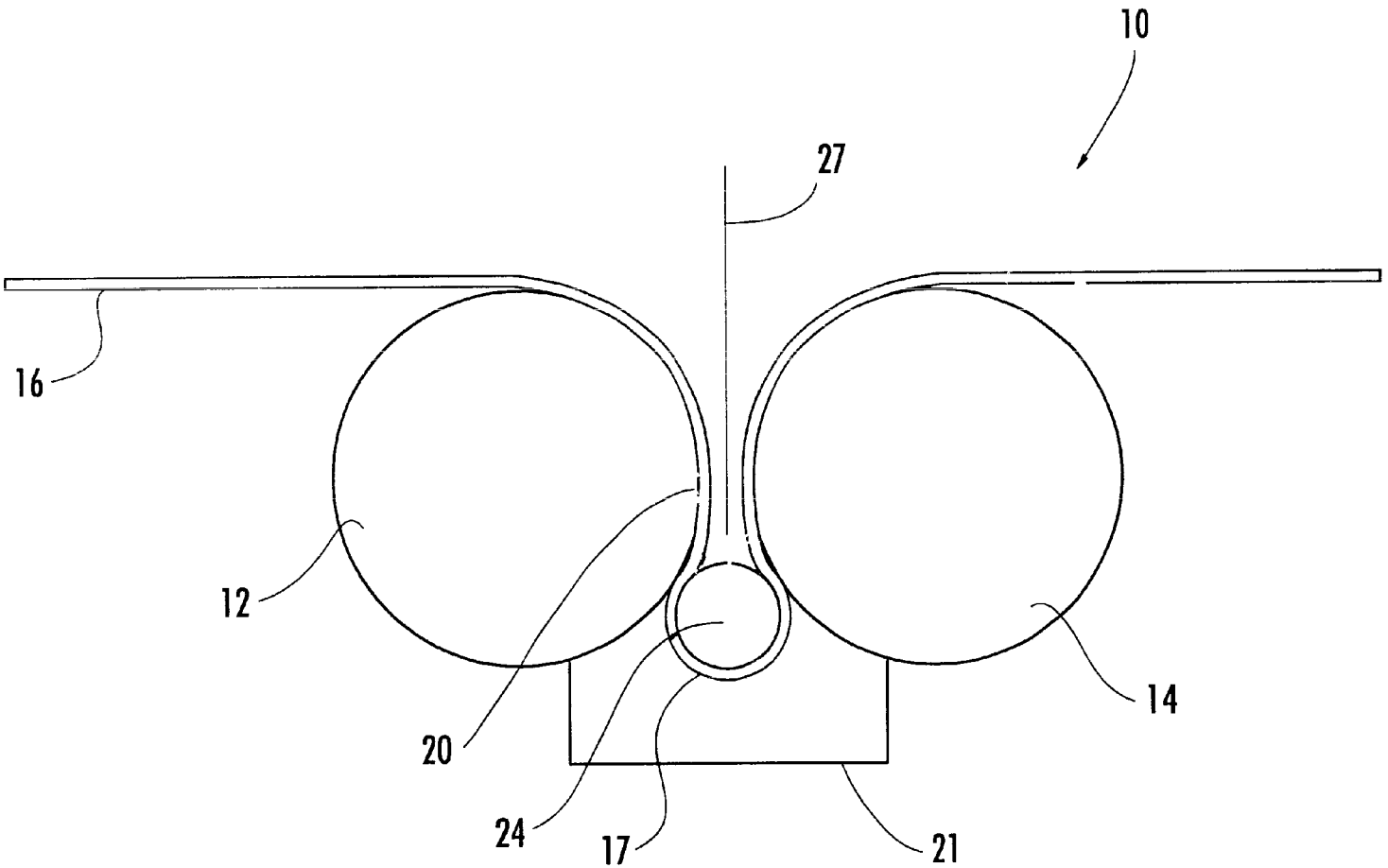

FIG. 3 is a schematic side view of parts of the fabric dewatering device showing a third embodiment which includes a rider roll inserted in a trough portion of the fabric.

Figure 4:
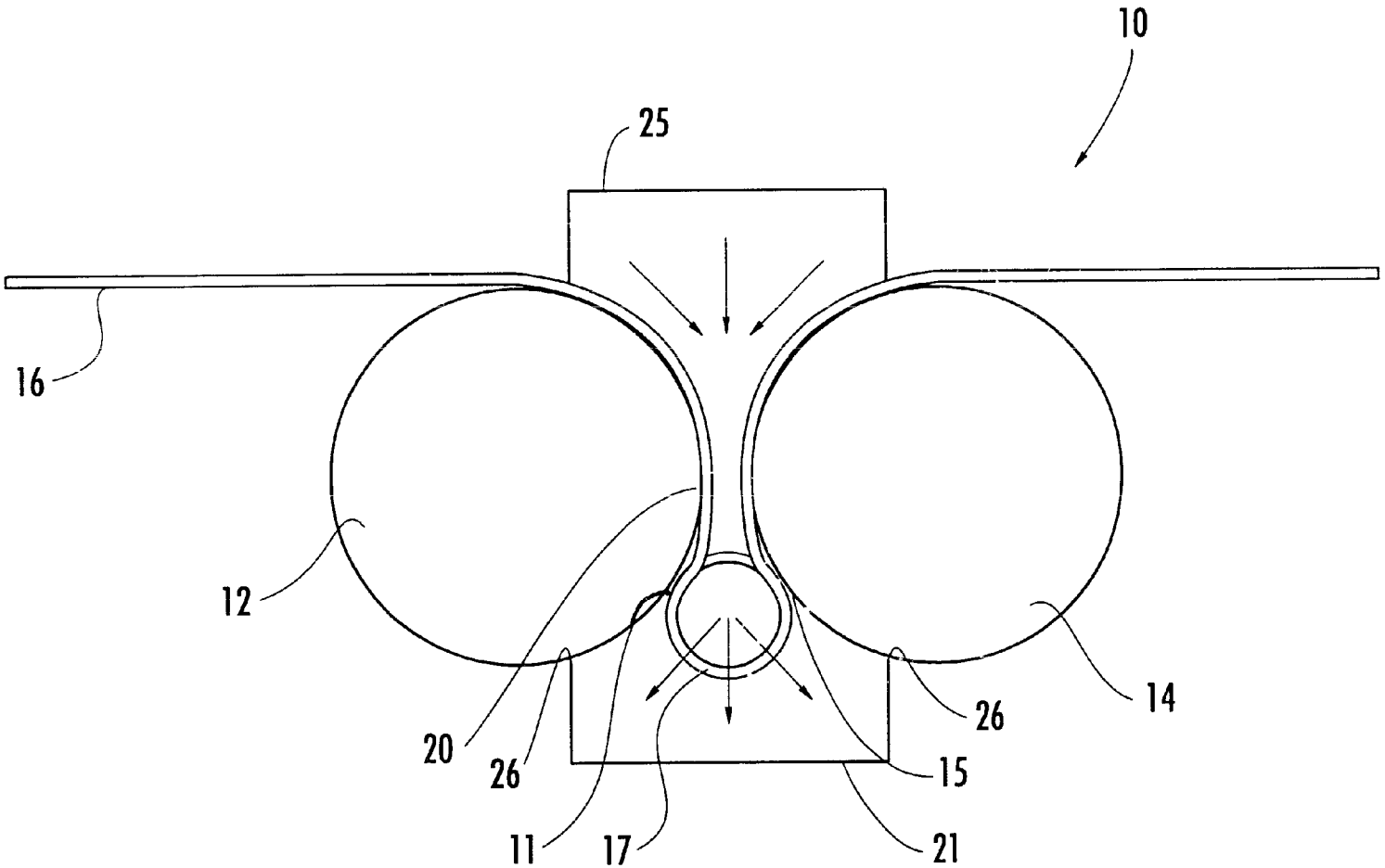

FIG. 4 is a schematic side view of parts of the fabric dewatering device as shown in FIG. 3 further comprising an air plenum positioned above the rider roll.

Figure 5:
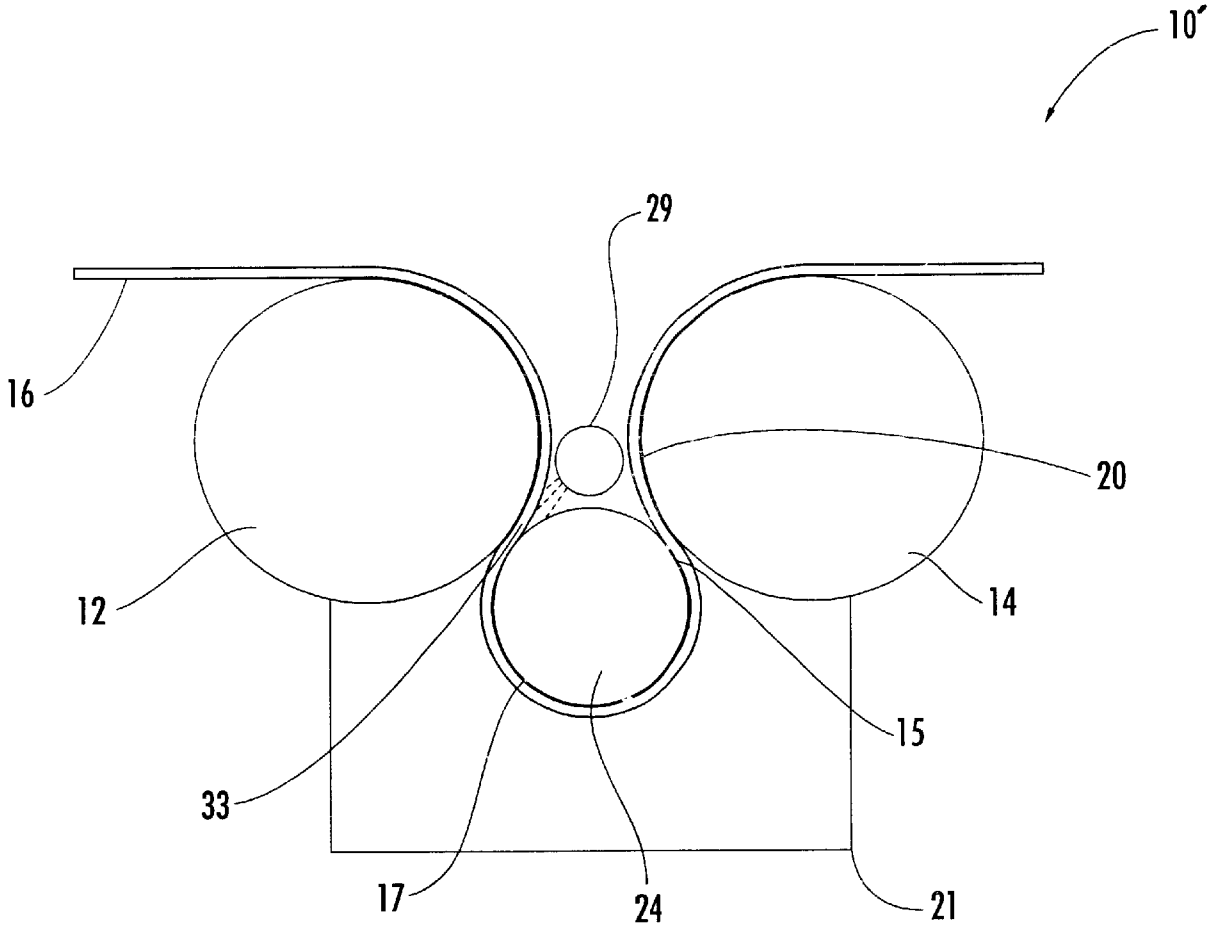

FIG. 5 is a schematic side view of parts of the fabric dewatering device showing a fourth embodiment which includes a shower pipe suspended above a rider roll.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIGS. 1 through 5 schematically depict several embodiments of a fabric dewatering device 10 for fabrics used in a papermaking process. FIG. 1 is a schematic depiction of a first embodiment of the fabric dewatering device 10 showing a continuous fabric 16 passing through the device. The fabric passes through a lead nip 11 formed between a top roll 13 and a leading guide roll 12. The fabric then passes through a trailing nip 15 formed between the top roll 13 and a trailing guide roll 14. Between the lead nip 11 and the trailing nip 15 the fabric 16 forms a loop 20 with a trough portion 17 that has a small radius relative to that of the leading and trailing guide rolls 12 and 14. Movement of the fabric 16 with a relatively high linear speed induces a centrifugal force that throws water out from the fabric when it is forced to swing through the relatively small radius of the fabric loop 20 and trough portion 17. This water is captured and prevented from falling on electrical parts, or the paper web being manufactured, by a collection pan 21.

The leading guide roll 12 and the trailing guide roll 14 are preferably two parallel cylindrical rolls of equal diameter and with hard outer surfaces. The rolls 12 and 14 are rotatable about their respective long axes and are supported in a suitable frame (not shown) of a papermaking machine wherever dewatering a fabric belt or web is desired. The rolls 12 and 14 extend in a cross-machine direction, transverse to the direction of travel of the continuous fabric 16, and are the same length, or longer, than the transverse width of the fabric.

The top roll 13 is a rotatable cylindrical roll and has a covering 18 of rubber or other deformable material on its outside surface. Unlike the leading and trailing guide rolls 12 and 14, the top roll 13 has an adjustable center axis 19. Adjustments in the position of the center axis 19 can be either manual or by way of an automatic control in response to an electrical or mechanical signal. Preferably, a non-contact sensor 30 detects the position of the trough portion 17 and sends a signal to a controller 31, which is connected to an actuator (not shown) operable to move the roll 13 toward and away from the guide rolls 12 and 14.

Adjusting the position of top roll 13 in relation to the guide rolls 12 and 14 varies the amount of indentation of the deformable cover 18 at the leading and trailing nips 11 and 15, which regulates the length of loop 20 and hence the radius of the trough portion 17. Preferably, the minimum indentation required to grip the fabric 16 is used at the lead nip 11, while a greater indentation is used at the trailing nip 15 so that the fabric speed entering the trailing nip is reduced. Because the length of the fabric 16 will increase as tension is applied, the surface speed of the fabric at the entrance of the trailing nip 15 will always be slower than the surface speed of the fabric at the entrance of the lead nip 11. The fabric 16 runs at constant tension and speed outside of the fabric dewatering device 10, but between the nips 11 and 15, the loop 20 runs at nearly zero tension and a lower surface speed. The fabric speed differential between the leading and trailing nips 11 and 15 depends on the modulus of the fabric 16. A lower modulus results in more fabric stretch at the trailing nip 15, and hence a greater speed differential between the nips.

In other embodiments, it is possible to construct the top roll 13 of a range of materials. For instance, the top roll 13 could be constructed entirely of deformable material rather than a deformable cover 18 on a hard roll. Various deformable materials can be used. Rubber is a suitable material due to its relatively low modulus of elasticity, high durability and excellent friction characteristics.

Any of the three rolls 12, 13 and 14 can be driven by a conventional drive system such as an electric motor operably attached to the axes of the rolls through a speed reducer. FIG. 1 depicts a drive 32 coupled with the top roll 13. Driving the leading guide roll 12, the top roll 13, or both, maintains tension on the fabric as it travels through the lead nip 11 on the upstream end of the dewatering device 10. Driving the trailing guide roll 14, the top roll 13, or both, restrains the downstream flow of the fabric as it travels through the trailing nip 15. Driving any one of the rolls 12, 13 and 14 will result in rotation of all three rolls due to the contact forces present in both of the nips 11 and 15.

The actual dewatering process is best illustrated by describing the path of the fabric 16 as it travels into and through the fabric dewatering device 10. Upstream of the fabric dewatering device 10, the fabric 16 supports a paper web during the manufacturing process. In some applications, the paper web may be a textured tissue paper that is dried on a through-air-drier (TAD) fabric. These fabrics have a special textured structure and a definite thickness. After the fabric 16 is separated from the paper web, it is cleaned of any fibers or other contaminates that adhered to it during the papermaking process. It is cleaned using a conventional washing technique that typically involves spraying water onto the fabric. Before the fabric returns to pick up more of the paper web, the fabric 16 is drawn at a fixed speed into the fabric dewatering device 10 by the tension in the lead nip 11.

Due to the decrease in the speed of travel of the fabric 16 between the lead nip 11 and the trailing nip 15, little or no tension is present in the loop 20 of the fabric 16. There is clearance between the two guide rolls 12 and 14 in the machine direction. This permits the fabric 16 to form loop 20 by extending downward over a portion of the circumference of the leading guide roll 12. The bending stiffness of the fabric 16 causes the formation of the trough portion 17 below the plane formed by the axes of the guide rolls 12 and 14. The loop 20 is completed as the fabric 16 extends up a portion of the trailing guide roll 14 and into the trailing nip 15.

Water is expelled from the soaked fabric 16 because the relatively high linear speed swinging through a small radius trough portion 17 induces large centrifugal forces. Preferably, the diameter of trough portion 17 will be in the range of 50 mm to 100 mm. At a fabric speed of 15 meters per second (m/s), the water experiences a force of over 450 times gravity for the 100 mm diameter trough portion 17. Halving the diameter of the trough portion 17 to 50 mm increases this to 900 times gravity. Because of the orientation of the loop 20 suspended between the guide rolls, the water tends to be expelled generally downward and laterally outward. As it is flung out of the fabric 16, the water is captured in the collecting pan 21 disposed below and surrounding the trough portion 17, where it flows away through a drain (not shown).

After the traveling fabric 16 exits the dewatering device 10 through the trailing nip 15, its water load has been reduced. Depending upon the tolerance of the papermaking process for the remaining water in the web 16, it can either be immediately returned to pick up more of the paper web, or it can be sent to another drying apparatus. Vacuum and forced air drying apparatuses are usually expensive to operate when water loads are high. However, the water load is greatly reduced when the fabric 16 has been pretreated by the dewatering device 10, making a serial use of drying apparatuses an effective strategy for dewatering fabric. The fabric can be passed sequentially through two or more dewatering devices 10, if desired.

A second embodiment of the fabric dewatering device is schematically depicted in FIG. 2. The second embodiment replaces the top roll 13 of the first embodiment with a top leading roll 22 and a top trailing roll 23. The top leading roll 22 and the leading guide roll 12 form the lead nip 11. The top trailing roll 23 and the trailing guide roll 14 form the trailing nip 15. Of the two rolls forming each nip 11 and 15, one of them is driven by a drive assembly (not shown). The top leading roll 22 and the top trailing roll 23 can be run at different speeds so as to allow the formation of the loop 20. A sensor system 31 as described in the first embodiment can be used for detecting the position of the trough portion 17 to control the speed of the two top rolls 22 and 23. An advantage of the use of two top rolls over one is that it eliminates the need for the deformable cover 18 and allows freer air access through the gap between the top lead and trailing rolls 22 and 23.

A third embodiment (shown in FIG. 3) eliminates the top rolls and includes a rider roll 24 that is inserted within the trough portion 17 of the fabric 16 to control the position and geometry of the trough portion. The diameter of the rider roll 24 is preferably between 50 mm and 100 mm. The ends of the rider roll 24 need not be supported, but some form of restraint of the rider roll 24 in the cross-machine direction is required. Preferably, the roll ends are shaped into blunt cones (not shown) which are arranged to rub against plastic strips (not shown). Alternatively, light arms and bearings can support the ends of the rider roll 24. The fabric 16 and guide rolls 12 and 14 provide the restraint required to prevent the rider roll 24 from whirling. This allows operation at higher rotational speeds of about 6000 rpm for the 50 mm diameter rider roll. The rider roll 24 may also be of disk type or other segmented construction, with or without a fixed or revolving shaft.

Increasing the dwell length and time that the fabric passes through the small-radius path increases the dewatering effect of the centrifugal forces for a given level of centrifugal force. The dwell time can be increased by increasing the angle of wrap of the fabric about the rider roll 24. The wrap is preferably on the order of 290°, which corresponds to a dwell length of about 250 mm and a dwell time of 16 ms at fabric 16 travel speeds of 15 m/s for a rider roll 24 diameter of 100 mm. The centrifugal forces exerted in this case are on the order of 450 times the force of gravity (g). Operation at the same fabric speed with a 50 mm diameter rider roll 24 would double the centrifugal forces from 450 g to 900 g, but would halve the dwell length and time to 125 mm and 8 ms. Wrap angles of 200° to 300° are suitable.

The third embodiment can also include a midfeather deflector 27, which is a plate structure positioned between the leading guide roll 12 and the trailing guide roll 14. The plate structure of the deflector 27 prevents water flung from the portion of the fabric upstream of the trough portion 17 from rewetting the exiting portion of the fabric web 16 downstream of the trough portion 17.

FIG. 4 depicts a fourth embodiment, which is similar to the third embodiment, except that the rider roll 24 is permeable and air is discharged through the permeable rider roll 24 so as to pass through the fabric 16. Air flow can be generated using an air knife (not shown) or an air supply plenum 25 with the air flow directed toward the permeable rider roll 24 and the trough portion 17. Air flow can also be generated using a vacuum source (not shown) attached to the collecting pan 21 that would draw air through the permeable rider roll 24 and the trough portion 17. Preferably, a vacuum seal 26 on the collecting pan 21 seals against the guide rolls to prevent leakage of air between the guide rolls 12 and 14 and the collecting pan. Using the air knife and the vacuum source together is also a possibility if additional air flow is desired through the loop portion 20.

FIG. 5 schematically depicts a fifth embodiment comprising a fabric cleaning device 10' that includes the use of a flooded nip and/or scarfing shower to clean and dewater the fabric 16. The device 10' includes a permeable rider roll 24 and a shower pipe 29. The rider roll 24 is of larger diameter than in the previously described embodiments to allow clearance for the shower pipe 29 which is positioned above the rider roll. Water from the shower pipe 29 floods a nip 33 between the lead guide roll 12 and the rider roll 24 so as to clean the fabric 16 as it passes around the rider roll 24. One or more dewatering devices (of any of the previously described embodiments) could be arranged in series with the cleaning device 10' to cleanse and/or dewater the fabric 16 continuously, thus forming a cleaning and dewatering system. The large centrifugal forces in the cleaning device 10' can increase cleaning efficiency, and the device 10' can have a more compact arrangement than a conventional flooded nip device.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A device for dewatering a fabric used in a paper machine, comprising:

a leading guide roll rotatable about an axis thereof;

a trailing guide roll rotatable about an axis thereof and parallel to the axis of the leading guide roll, the leading and trailing guide rolls being spaced apart such that the fabric passes over a portion of a circumference of the leading guide roll and then over a portion of a circumference of the trailing guide roll in the same rotational direction about both rolls so as to form a fabric loop between said leading guide roll and said trailing guide roll, said fabric loop including a trough portion having a position that falls below the axes of the rolls and having an optimal desired geometry, said position and geometry being such that the fabric loop has a radius of curvature sufficiently small to cause water to be expelled from the fabric by centrifugal force; and a control device including a drive connected to each of the rolls and operable to rotate each roll about the axis thereof in the same rotation direction, and a sensor for detecting the position of the trough portion of the fabric loop, said control controlling rotational speed for each roll so as to maintain the position of the trough portion below the axes of the rolls.

2. The fabric dewatering device as claimed in claim 1, further comprising a lead nip and a trailing nip, said lead nip formed between a first surface and the leading guide roll, said trailing nip formed between a second surface and the trailing guide roll, wherein the fabric loop passes through the lead nip upstream of the trough portion and passes through the trailing nip downstream of the trough portion.

3. The fabric dewatering device as claimed in claim 2, wherein said first surface is a portion of a first roll and said second surface is a portion of a second roll.

4. The fabric dewatering device as claimed in claim 2, wherein said first and second surfaces comprise portions of a single top roll in nipping engagement with both the leading and trailing guide rolls.

5. The fabric dewatering device as claimed in claim 4, wherein said single top roll is deformable so as to form an extended nip when pressed against one of the leading and trailing guide rolls.

6. The fabric dewatering device as claimed in claim 1, wherein a diameter of said trough portion does not exceed 100 millimeters.

7. The fabric dewatering device as claimed in claim 1, wherein a diameter of said trough portion does not exceed 50 millimeters.

8. The fabric dewatering device as claimed in claim 1, further including a collection pan positioned below the trough portion of said loop and capturing water falling therefrom.

9. The fabric dewatering device as claimed in claim 1, further comprising a deflector positioned between the leading guide roll and the trailing guide roll so as to prevent water flung from the fabric upstream of the trough portion from rewetting the fabric downstream of the trough portion.

10. The fabric dewatering device as claimed in claim 2, further comprising a shower pipe positioned in proximity to the leading guide roll so as to be capable of flooding the lead nip.

11. A method for dewatering a traveling fabric used in making paper, the method comprising:

advancing the fabric about a portion of a circumference of a leading guide roll rotatable about an axis thereof and about a portion of a circumference of a trailing guide roll rotatable about an axis thereof parallel to and spaced from the leading guide roll, the fabric passing about each guide roll in the a same rotational direction as said rolls and forming a fabric loop between the guide rolls, the fabric loop defining a trough portion having a position spaced to one side of a plane that passes through the axes of the guide rolls; and controlling speed of the fabric passing over the leading guide roll and speed of the fabric passing over the trailing guide roll by detecting the position of the trough portion using a sensor, providing an output from the sensor to a drive connected to each of the rolls and driving the rotation of each roll with the drive and in response to the sensor output so as to maintain the position of the trough portion of the fabric loop.

12. The method of dewatering a fabric as claimed in claim 11, further comprising forming a lead nip at the leading guide roll upstream of the fabric loop, and forming a trailing nip at the trailing guide roll downstream of the fabric loop, the fabric passing through both nips.

13. The method of dewatering a fabric as claimed in claim 12, wherein the lead nip is formed between the leading guide roll and a first roll and the trailing nip is formed between the trailing guide roll and a second roll.

14. The method of dewatering a fabric as claimed in claim 12, wherein both nips are formed between the guide rolls and a top roll in nipping engagement with both guide rolls.

15. The method of dewatering a fabric as claimed in claim 14, wherein the top roll is deformable and is urged against the trailing guide roll with a greater force than against the leading guide roll such that a greater degree of deformation of the top roll occurs at the trailing guide roll than at the leading guide roll.

16. The method of dewatering a fabric as claimed in claim 11, further comprising preventing water from being slung from the fabric upstream of the fabric loop onto the fabric downstream of the fabric loop by positioning a deflector between the two guide rolls.

17. A method for dewatering a traveling TAD fabric having a thickness and used in making paper, the method comprising:

advancing the TAD fabric about a portion of a circumference of a leading guide roll rotatable about an axis thereof and about a portion of a circumference of a trailing guide roll rotatable about an axis thereof parallel to and spaced from the leading guide roll, the TAD fabric passing about each guide roll in a same rotational direction as said rolls and forming a fabric loop between the guide rolls, the fabric loop defining a trough portion having a position spaced to one side of a plane that passes through the axes of the guide rolls; and controlling speed of the TAD fabric passing over the leading guide roll and speed of the TAD fabric passing over the trailing guide roll so as to maintain said position of the trough portion of the fabric loop and induce centrifugal forces in the fabric loop so as to expel water therefrom without substantially compressing the thickness of the TAD fabric.

* * * * *